US007503814B1

(12) United States Patent
Lin

(10) Patent No.: US 7,503,814 B1
(45) Date of Patent: Mar. 17, 2009

(54) TERMINAL STRUCTURE OF FEMALE CONNECTOR

(76) Inventor: Jui-Hsiang Lin, 6F-1, No. 79, Sec. 1, Hang Chou S. Rd., Taipei City (TW)

( * ) Notice: Subject to any disclaimer, the term of this patent is extended or adjusted under 35 U.S.C. 154(b) by 0 days.

(21) Appl. No.: 12/103,714

(22) Filed: Apr. 16, 2008

(51) Int. Cl.
*H01R 13/11* (2006.01)

(52) U.S. Cl. ..... 439/857

(58) Field of Classification Search ..... 439/842, 439/943, 741, 855, 857, 733.1, 878, 748, 439/399, 342, 851
See application file for complete search history.

(56) References Cited

U.S. PATENT DOCUMENTS 3,503,036 A * 3/1970 Desso et al. ..... 439/857
3,818,423 A * 6/1974 McDonough ..... 439/857
3,824,557 A * 7/1974 Mallon ..... 439/857
4,385,794 A * 5/1983 Lucius ..... 439/399
4,606,599 A * 8/1986 Grant et al. ..... 439/857
6,099,360 A * 8/2000 Broschard et al. ..... 439/748
6,558,208 B2 * 5/2003 Suzuki ..... 439/878
2002/0111080 A1 * 8/2002 Recktenwald et al. ..... 439/851
2004/0142605 A1 * 7/2004 Harada et al. ..... 439/857
2008/0227324 A1 * 9/2008 Cheng et al. ..... 439/342

* cited by examiner

*Primary Examiner*—Alexander Gilman
(74) *Attorney, Agent, or Firm*—Leong C. Lei

(57) ABSTRACT

The terminal has two clamping pieces and two positioning pieces extended from an upper section and a middle section of the terminal, respectively. The width of the clamping pieces is exactly one half of that of the positioning pieces. In addition, a first positioning piece is U-shaped with two aims while a second positioning piece has a single arm whose shape fits the gap between the arms of the first positioning piece. As such, the terminals to be produced from a sheet of metal could be compactly arranged together. For a same sheet of metal, twice as many terminals of the present invention could be produced as the conventionally structured terminals.

2 Claims, 5 Drawing Sheets

TERMINAL STRUCTURE OF FEMALE CONNECTOR

(A) TECHNICAL FIELD OF THE INVENTION

The present invention generally relates to connectors, and more particularly to a novel structure of the terminals of a female connector which effectively reduces the material wasted during the manufacturing process.

(B) DESCRIPTION OF THE PRIOR ART

FIG. 6 shows how a number of terminals A1 commonly found in a female connector are manufactured. As illustrated, each terminal A1 has clamping pieces A11 and positioning pieces A12 extended from an upper section and a middle section of the terminal A1, respectively. The clamping pieces A11 are those that clamps the terminals of a male connector plugged into the female connector. The positioning pieces A12 are to securely and reliably hold the terminal A1.

As illustrated, the terminals A1 are punched from a sheet of metal. Due to the presence of the positioning pieces A12 between adjacent terminals A1, quite some material is wasted in the process, thereby increasing production cost and reducing competitiveness.

SUMMARY OF THE INVENTION

The primary purpose of the present invention is to provide a novel structure of the terminals of a female connector which is taught herein which effectively reduces the material wasted during the manufacturing process and doubles the production rate.

A terminal according to the present invention has two clamping pieces and two positioning pieces extended from an upper section and a middle section of the terminal, respectively. The width of the clamping pieces is exactly one half of that of the positioning pieces. In addition, a first positioning piece is U-shaped with two arms while a second positioning piece has a single arm whose shape fits the gap between the arms of the first positioning piece.

As such, the terminals to be produced from a sheet of metal could be compactly aligned together. For a sheet of metal, twice as many terminals of the present invention could be produced than the conventionally structured terminals. Therefore, the waste of material is significantly reduced and the production rate is effectively doubled.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
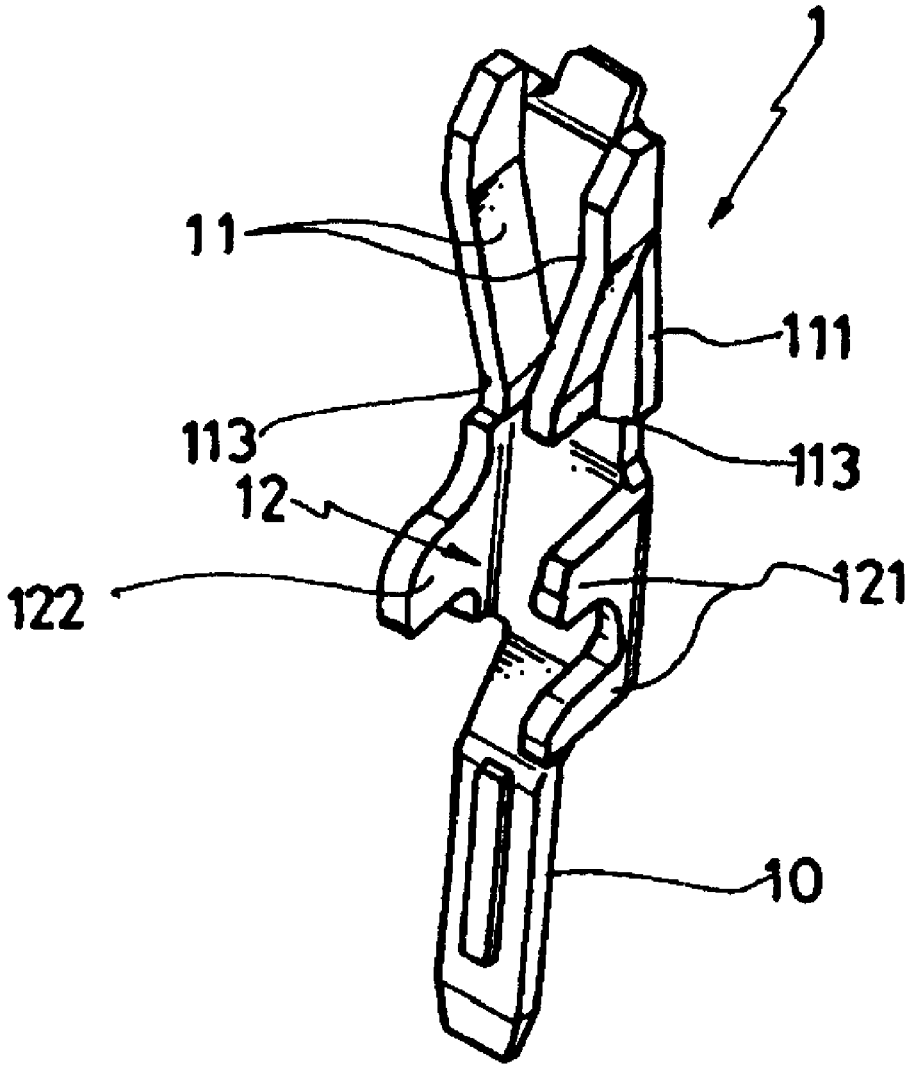
FIG. 1 is a perspective-view diagram showing a terminal according an embodiment of the present invention.
Figure 4:
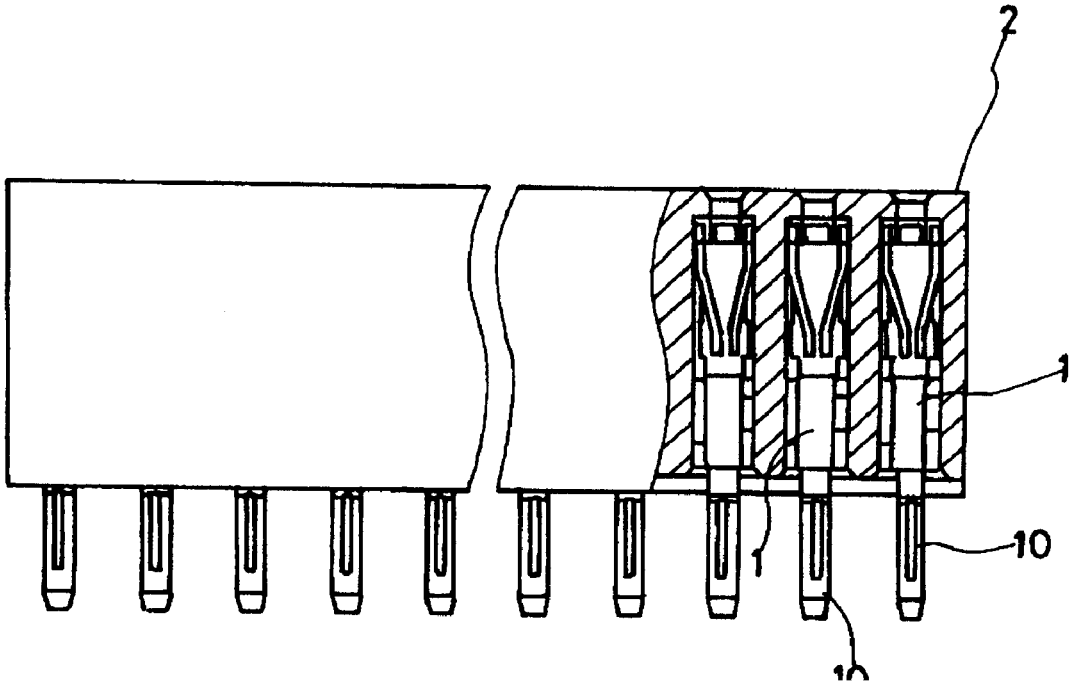
FIG. 4 is a schematic diagram showing the terminals of FIG. 1 embedded in a female connector.

As shown in FIGS. 1 and 4, terminals 1 according to an embodiment of the present invention are arranged at equal spacing in the body of a female connector 2. Each terminal 1, from top to bottom, has an upper section, a middle section, and a leg. The legs 10 of the terminals 1 are exposed from a bottom side of the connector 2 so that the connector 2 could be soldered to a circuit board (not shown). The legs 10 could have a pointed or leveled bottom tip.

Figure 2:
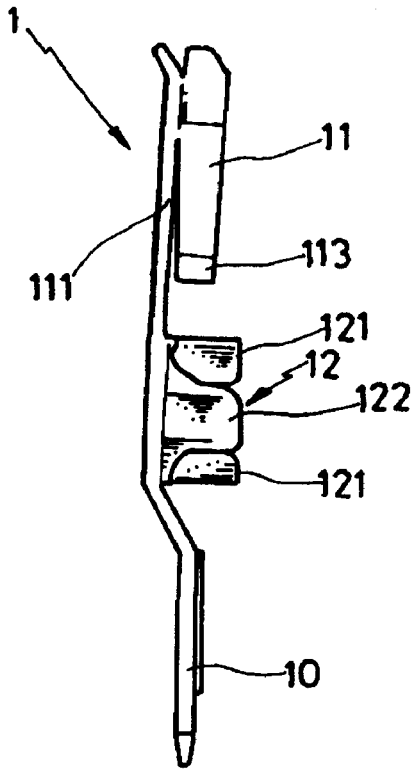
FIG. 2 is a side-view diagram showing the terminal of FIG. 1.
Figure 3:
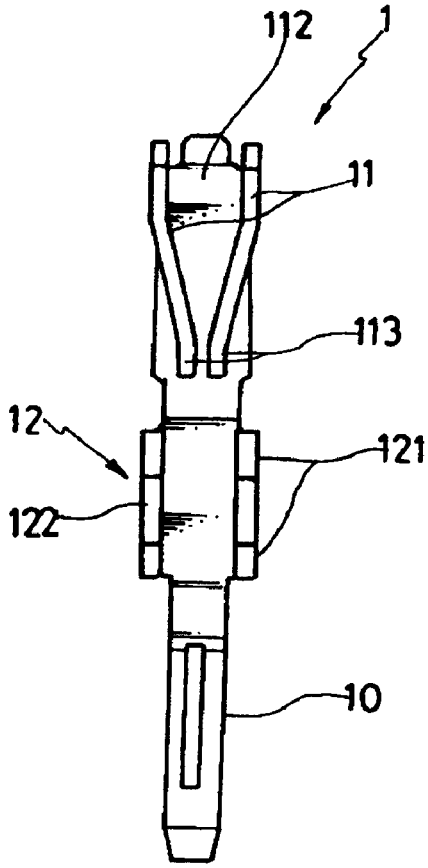
FIG. 3 is a front-view diagram showing the terminal of FIG. 1.

As further shown in FIGS. 2 and 3, two clamping pieces 11 are extended from two lateral sides of the upper section of the terminal 1, respectively. The connections between the clamping pieces 11 and the upper section of the terminal 1 are cut along a line 111, respectively, so that the clamping pieces 11 and the upper section are separated but remain partially connected. The clamping pieces 11 are then bended towards a front side of the terminal 1 until they are substantially perpendicular to the terminal 1. As such, the clamping pieces 11 and the upper section of the terminal 1 form a U-shaped cross section. The sections of the clamping pieces 11 that are separated from the terminal 1 are further bended towards each other so that the U-shaped cross section has a large opening 112 at a top end and is gradually reduced downwards. In other words, the distance between the clamping pieces 11 is gradually reduced from top to bottom. Bottom ends 113 of the clamping pieces 11 are slightly bended again so that they are substantially parallel to each other and form a significantly smaller opening. As such, the clamping pieces 11 of the terminal 1 are capable of sustaining a great number of plugging and unplugging of male terminals without losing their resilience.

As shown in FIGS. 1 to 3, two positioning pieces 11 are extended from two lateral sides of the middle section of the terminal 1, respectively. The positioning pieces 12 are also bended towards the front side of the terminal 1 until they are substantially perpendicular to the terminal 1. A first positioning piece 12 is U-shaped with two arms 121 while a second positioning piece 12 has a single arm 122. Please note that the width of the first and second positioning pieces 12 is identical and is exactly twice of that of the clamping pieces 11. Please note that the shape of the arm 122 matches the gap between the arms 121.

Figure 5:
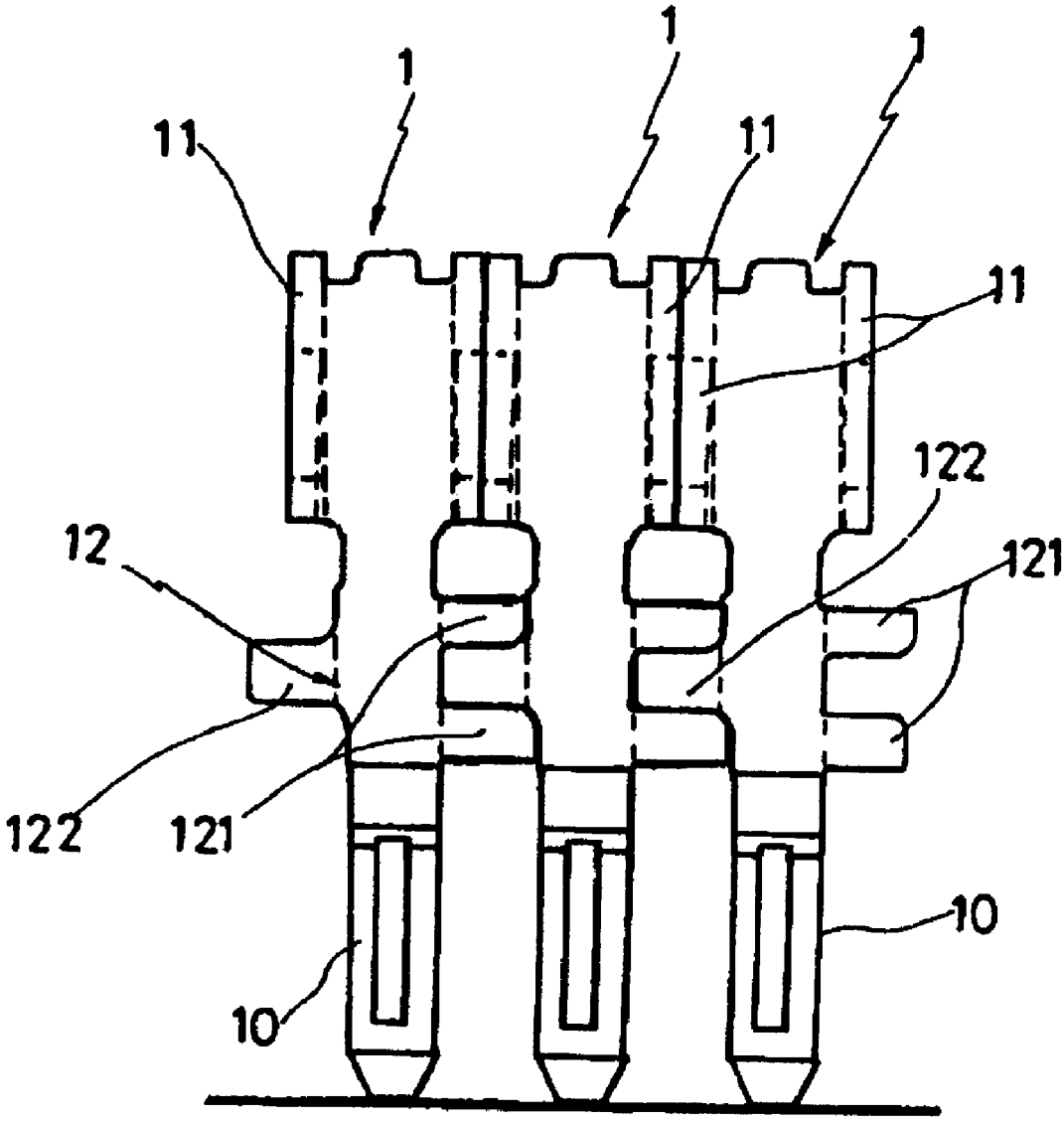
FIG. 5 is a front-view diagram showing how the terminals of FIG. 1 are arranged on a sheet of metal during the manufacturing process.
Figure 6:
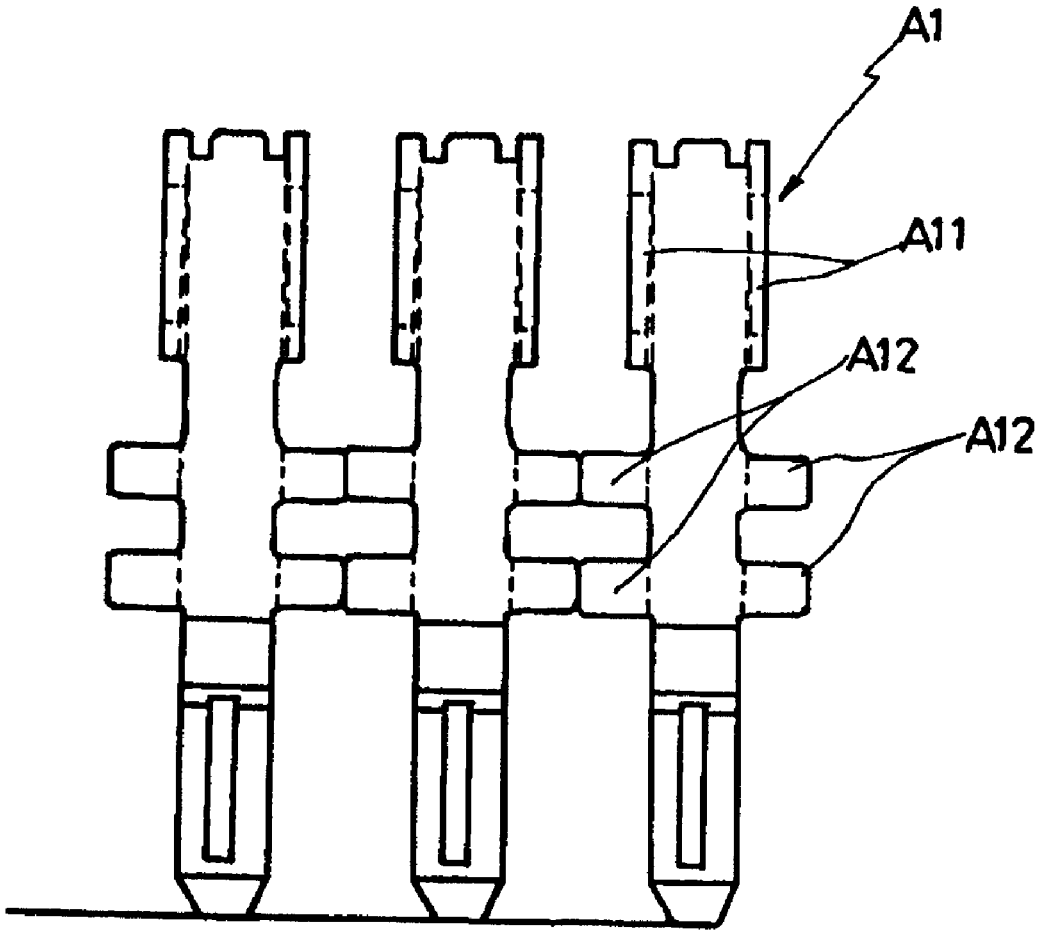
Fig . 6 PRIOR ART
FIG. 6 is a front-view diagram showing how conventional terminals are arranged on a sheet of metal during the manufacturing process.

As such, as shown in FIG. 5, the terminals 1 to be produced from a sheet of metal could be compactly arranged together, as the second positioning piece 12's arm 122 of a terminal 1 fits directly between the two arms 121 of the first positioning piece 12 of an adjacent terminal 1. For a sheet of metal, twice as many terminals 1 of the present invention could therefore be produced as the conventionally structured terminals. Therefore, the waste of material is significantly reduced and the production rate is effectively doubled.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A terminal of a female connector, comprising:

an upper section having two clamping pieces extended from two lateral sides of said upper section, respectively, said clamping pieces bended towards a front side of said terminal so that said clamping pieces is substantially perpendicular to said upper section;

a middle section below said upper section having two positioning pieces extended from two lateral sides of said middle section, respectively, said positioning pieces bended towards said front side of said terminal so that said positioning pieces are substantially perpendicular to said middle section; and a leg extended downwards from said middle section;

wherein a distance between said clamping pieces is gradually reduced from a top end to a bottom end of said clamping pieces; said clamping pieces has a width that is substantially one half of that of said positioning pieces; a first positioning piece is U-shaped with two arms; and a second positioning piece has a single arm whose shape matches a gap between said two arms of said first positioning piece.

2. The terminal according to claim 1, wherein said leg has a pointed or leveled bottom tip.

* * * * *